US006030111A

United States Patent [19]

Tokuyoshi et al.

[11] Patent Number: 6,030,111

[45] Date of Patent: Feb. 29, 2000

[54] METHOD OF AND SYSTEM FOR RECYCLING MOLDING SAND

[75] Inventors: Minoru Tokuyoshi; Toshisaburo Kimura; Takashi Suginaka, all of Hiroshima, Japan

[73] Assignee: Mazda Motor Corporation, Hiroshima, Japan

[21] Appl. No.: 09/037,734

[22] Filed: Mar. 10, 1998

[30] Foreign Application Priority Data

Mar. 10, 1997 [JP] Japan ..... 9-074458

[51] Int. Cl.[7] ..... B28C 5/00

[52] U.S. Cl. ..... 366/2; 366/4; 366/6; 366/10

[58] Field of Search ..... 366/2, 3, 4, 6, 366/7, 8, 10, 11, 16, 22, 139; 164/5

[56] References Cited

U.S. PATENT DOCUMENTS

| | | | |
|---|---|---|---|
| 4,106,112 | 8/1978 | Jones | 366/4 |
| 4,361,405 | 11/1982 | Wedek et al. | 366/7 |
| 4,738,615 | 4/1988 | Bailey et al. | 164/5 |
| 5,268,195 | 12/1993 | Weisskopf | 164/5 |
| 5,271,450 | 12/1993 | Bailey | 164/5 |
| 5,330,265 | 7/1994 | Keating, Jr. et al. | 366/7 |
| 5,816,312 | 10/1998 | Suginaka et al. | 366/7 |

FOREIGN PATENT DOCUMENTS 3-9245 1/1991 Japan .

*Primary Examiner*—Tony G. Soohoo

*Attorney, Agent, or Firm*—Sixbey, Friedman, Leedom & Ferguson, PC; Donald R. Studebaker

[57] ABSTRACT

Molding sand of a used greensand mold is recycled by adding water and binder to sand particles fatigued by heating applied by a molten metal during molding and segregated from vigorous molding sand not directly heated by the molten metal and mixing the refreshed molding sand particles with the vigorous molding sand.

13 Claims, 8 Drawing Sheets

METHOD OF AND SYSTEM FOR RECYCLING MOLDING SAND

BACKGROUND OF THE INVENTION

1. Field of the Invention

The invention relates to a method of recycling molding sand by mixing molding sand collected after use as a greensand mold with water and binder.

2. Description of the Related Art

In greensand molding, it is typical to recycle fatigued molding sand of a greensand mold which has been partly subjected to thermal deterioration by exposure to hot a molten material during molding of a product. As shown by way of example in FIG. 6, recycling of fatigued molding sand after having been used for a greensand mold includes several steps of disassembling a molding box to take out the greensand mold at step SA3 after forming a greensand mold in the molding box at step SA1 and pouring a molten metal into the greensand mold to mold a product at step SA2, collecting the entire part of molding sand having been used for the greensand mold at step SA4, and kneading and smoothing the collected molding sand mixed with water and a given amount of binder such as bentonite so as to revive or refresh thermally deteriorated part of the molding sand at step SA5. The revived molding sand is reused for another greensand mold at step SA1. During molding a product at step SA2, the greensand mold at its outer-shell portion is exposed directly to a hot molten material. In the prior art molding sand recycling, a binder such as bentonite is added to the entire amount of collected molding sand, which always needs a large amount of the binder, and leads to an increased cost of a greensand mold.

A water supply installation is used in the step of mixing the molding sand with water. For example, as described in Japanese Unexamined Utility Model Publication No. 3-9245 and shown in FIG. 7, a water supply installation 64 monitors the temperature or the like of molding sand 63 collected onto a belt conveyer 62 and smoothed with a scraper 61 and sprays or pours a desired amount of water into the molding sand 63 through a pouring nozzle 65. While the water supply installation can adjust an proper amount of water and pour it into the molding sand, a binder such as bentonite is added to the whole part of the molding sand, which always needs a large amount of binder and brings about an increase in cost of a greensand mold.

SUMMARY OF THE INVENTION

It is an objective of the invention to provide a method of recycling molding sand of a used greensand mold by segregating fatigued molding sand due to heat from a molten metal from vigorous molding sand not directly heated by the molten metal and, after adding the fatigued molding sand with water and binder and kneading the water-mixed sand, mixing and kneading the water-mixed sand and the vigorous molding sand.

It is another object of the invention to provide a method of recycling molding sand of a used greensand mold in which a mixture of fatigued molding sand with water and binder is kneaded in a vacuum kneading machine.

It is another object of the invention to provide a method of recycling molding sand of a used greensand mold in which molding sand fatigued due to heat from a molten metal is segregated from vigorous molding sand not directly heated by the molten metal by means of vibrating screening means and securely collected.

It is still another object of the invention to provide a method of recycling molding sand of a used greensand mold which needs only a significantly reduced amount of binder necessary to refresh molding sand of an used greensand mold.

The foregoing objects of the present invention are achieved by providing a method of recycling molding sand of an used greensand mold comprises the steps of segregating and collecting separately fatigued molding sand which forms an outer-shell portion of a greensand mold exposed almost directly to heat from a molten material during molding from vigorous molding sand which forms an inner-shell portion of the greensand mold surrounding the outer-shell sand, providing and kneading a mixture of the fatigued molding sand with water and binder to reproduce refreshed molding sand and mixing the refreshed molding sand with the vigorous molding sand. The used green mold, after separated from a molding flask or box and broken, is transported on a vibrating screening plate with slots to segregate fatigued molding sand particles from clogs of vigorous molding sand. The fatigued molding sand is mixed and kneaded together with water and binder in a vacuum kneading machine.

With the molding sand recycling method, binder is added to molding sand fatigued by heat from a molten metal during molding only, the consumption of binder necessary to recycle used molding sand is significantly reduced, which is always desirable to reduce costs of a greensand mold, and hence costs of molding. Furthermore, since sand kneaded in a vacuum has a strength higher for a higher sand temperature and the effect of strengthening sand is enhanced with an increase in sand temperature, kneading a mixture of fatigued molding sand at a high temperature with water and binder in a vacuum yields an enhanced effect of reducing the consumption of binder. The reason for an increase in the strength of used molding sand depending upon sand temperature during kneading is considered as the result that the amount of cooling water supplied to the used molding sand is increased depending upon a rise in sand temperature and the amount of vapor in the kneading machine is correspondingly increased, which yields an increase in the amount of water permeating into interlayers of a stratified crystal structure of bentnite and adsorbed by the crystals and, as a result, enhances activation of the binder.

Because fatigued part of a used greensand mold is easily collapsible due to thermal deterioration, the fatigued molding sand is easily segregated from the vigorous molding sand to turn to fine sand particles while subjected to vibration on the slit type of vibrating screening means and fall through slits of the vibrating screening means while being transported on the vibrating screening means. In this way, the fatigued molding sand is securely separated from the vigorous sand clods and collected efficiently.

BRIEF DESCRIPTION OF THE DRAWINGS

The foregoing and other objects and features of the present invention will be clearly understood from the following detailed description of preferred embodiments when read in conjunction with the accompanying drawings in which.

DETAILED DESCRIPTION OF THE PREFERRED EMBODIMENT

Figure 1:
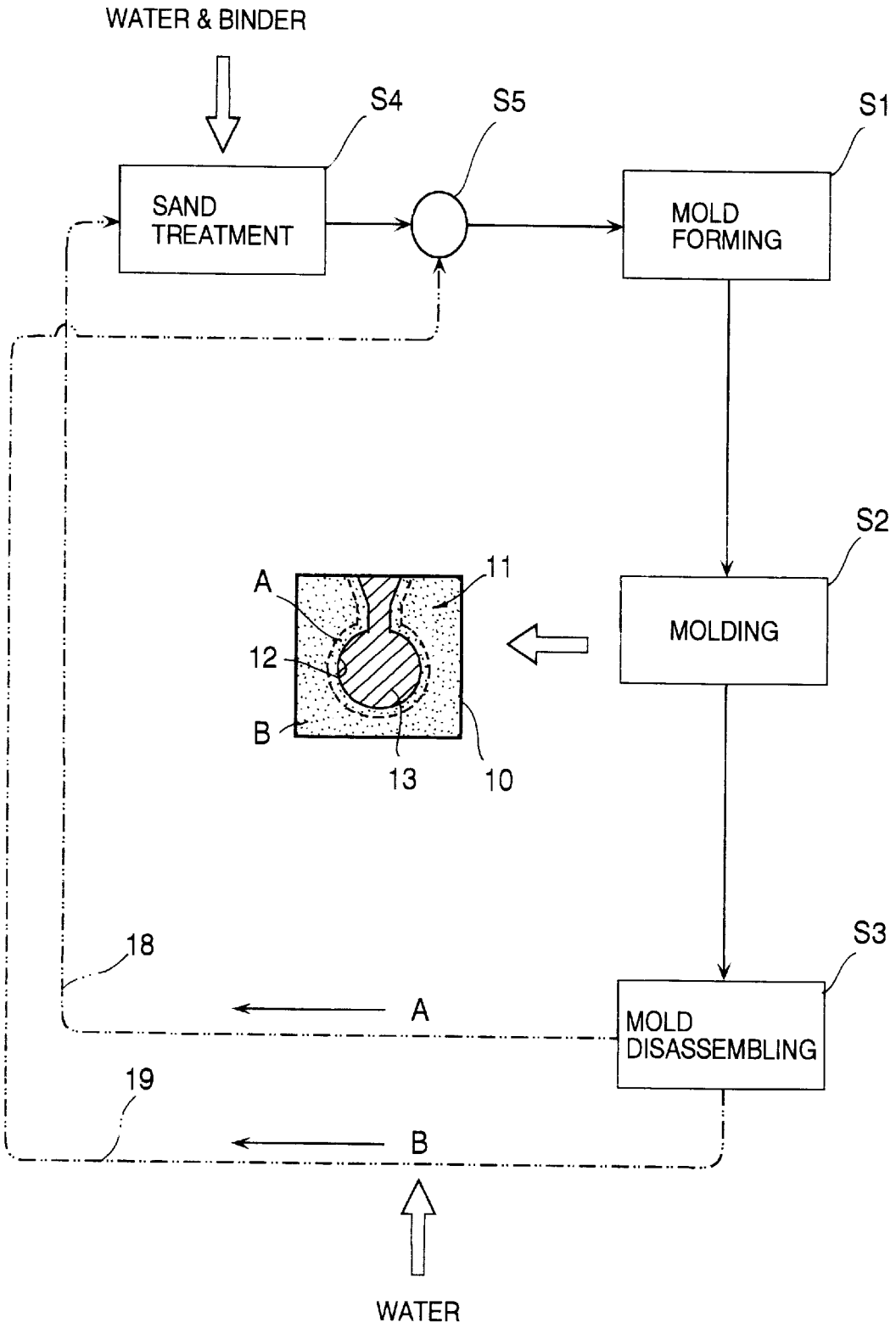
FIG. 1 is a block diagram showing a method of recycling used molding sand in accordance with an embodiment of the invention.

Referring to the drawings in detail and, in particular, to FIG. 1 schematically showing the whole process of recycling molding sand, a greensand mold 11 is provided at a mold forming station S1. At a molding station S2, a molten material 13 is poured and filled into the interior 12 of the greensand mold 11 to mold a product. During molding, the greensand mold 11 is exposed to heat transferred from the molten material 13 at a significantly high temperature with the result of thermal deterioration of an approximately 2 cm thick outer-shell or crust of molding sand A of the greensand mold 11. The remaining part, i.e. the inner-shell or crust, of molding sand B of the greensand mold 11 is not subjected directly to the heat and is consequently almost free from thermal deterioration.

Figure 2:
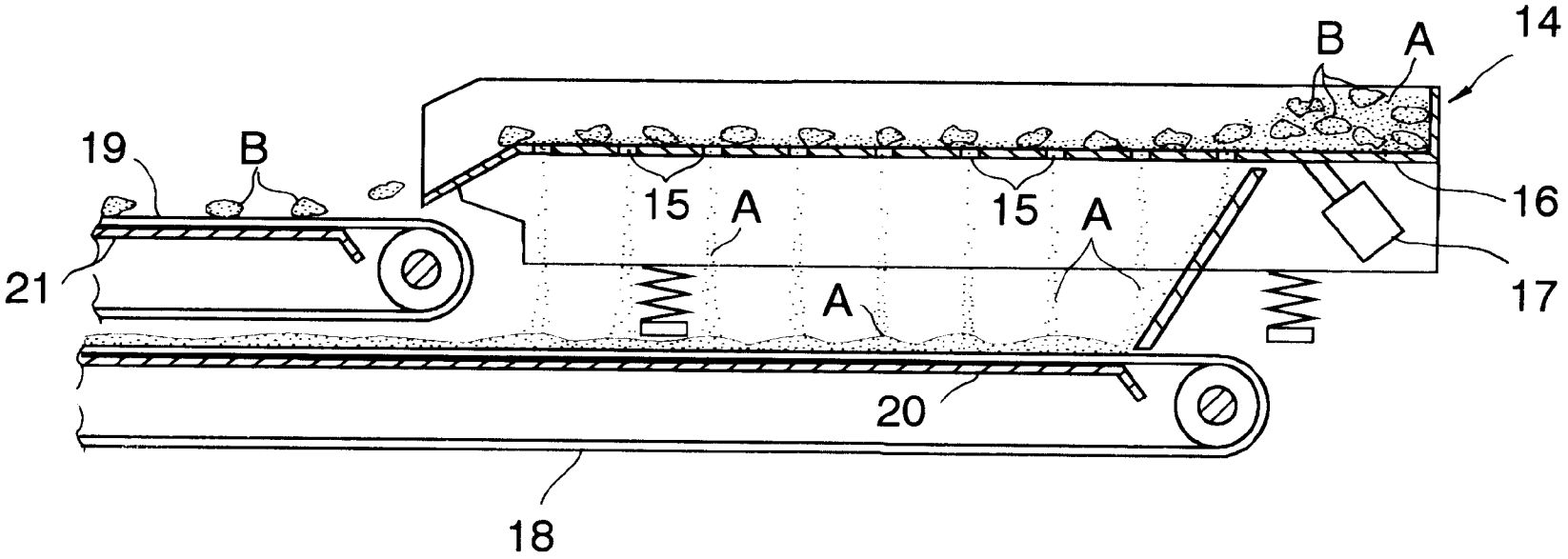
FIG. 2 is a schematic illustration showing a vibrating conveyer for separately collecting fatigued molding sand and vigorous molding sand clogs.

After having accomplished molding, a molding flask 10 is disassembled to separate the molded product 13 from the greensand mold 11 at a disassembling station S3. The greensand mold 11 is broken down to segregate the deteriorated or fatigued molding sand A from the molding sand B remaining vigorous. Segregation of the fatigued molding sand A from the vigorous molding sand B is accomplished by a vibrating conveyer 14 which is shown in FIG. 3 and will be described in detail later. As shown in FIG. 2, the vibrating conveyer 14 applies vibrations to the broken greensand mold 11 on a screening plate 16 to segregate particles of the fatigue molding sand A from clods of the vigorous molding sand B and to turn the fatigued molding sand A to fine and smooth grains of molding sand. Since the fatigued molding sand A has become smooth and easily collapsible due to thermal deterioration, the fatigued molding sand A is easily segregated from the vigorous molding sand B and turns to fine-grains of molding sand while subjected to vibration by the vibrating conveyer 14. While the fine grains of fatigued molding sand A and the clods of vigorous molding sand B are transported forward on the screening plate 16 of the vibrating conveyer 14, they are screened by the screening plate 16. It is well known in the art that bentonite turns to a gel when molding sand is exposed to and deteriorated by heat during molding and the gelled bentonite is not activated even if mixed with water. Specifically, the clods of vigorous molding sand B are delivered onto a belt conveyer 19 at the forward end of the vibrating conveyer 14 and, on the other hand, the fine-grains of fatigued molding sand A pass through slits 15 of the screening plate 16 of the vibrating conveyer 14 and fall onto a belt conveyer 18 disposed below the vibrating conveyer 14. The belt conveyer 18 is guided by a belt guide 20 extending from the disassembling station S3 to a sand treating station S4 where the fine-grains of fatigued molding sand A is mixed with a binder such as bentonite and water and the mixture is kneaded in a vacuum kneading machine 22. On the other hand, the belt conveyer 19 is guided by a belt guide 21 extending from the disassembling station S3 to a blending station S5. The clods of vigorous molding sand B put on the belt conveyer 19 are applied with water and stirred while transported from the disassembling station S3 to the blending station S5.

Figure 3A:
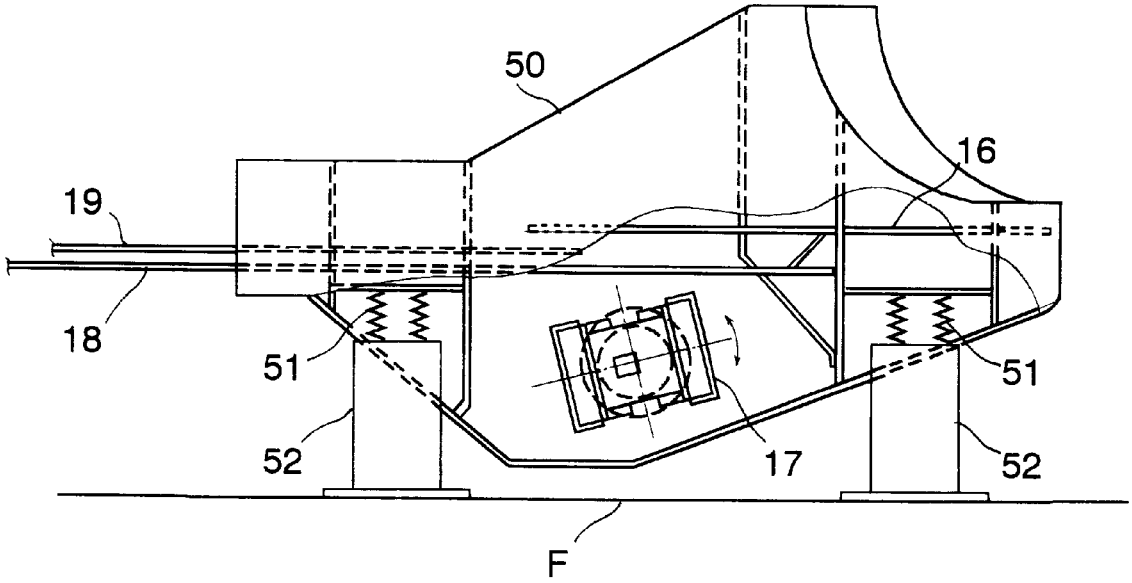
FIG. 3A is a side view of the vibrating conveyer.
Figure 3B:
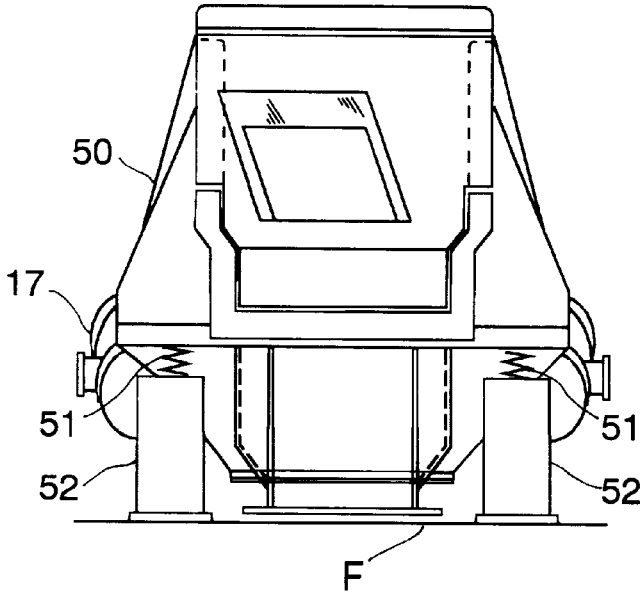
FIG. 3B is a front view of the vibrating conveyer.
Figure 3C:
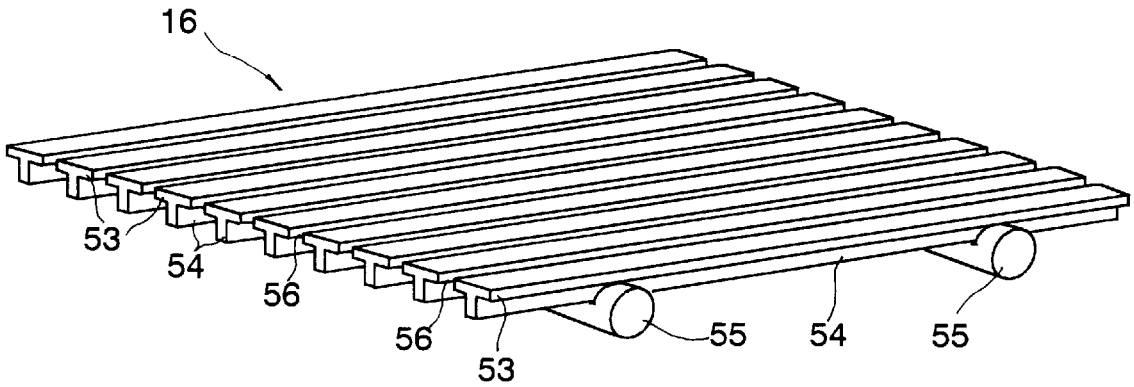
FIG. 3C is a perspective view of a screening plate.
Figure 3D:
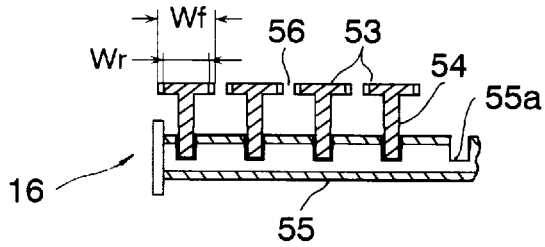
FIG. 3D is a cross sectional view showing partly the screening plate.

Referring to FIG. 3A through 3D showing the vibrating conveyer 14, the screening plate 16 is fixedly supported by a conveyer housing 50. The conveyer housing 50 is mounted on coil springs 51 supported on struts 52 standing from a floor F. A vibration generator 17 is fixedly installed to the conveyer housing 50 to generate vibration which is applied to the conveyer housing 50, and hence the screening plate 16, on the coil springs 51. The conveyer housing 50 is provided with front and rear support pipes 55 secured between side walls thereof. The screening plate 16 is installed to the support pipes 55. As shown in detail in FIGS. 3C and 3D, the screening plate 16 comprises a number of screening bars 53 having a T-shaped cross section. Each screening bar 53 has an integrall rib 54 set in groove 55*a* of front and rear support pipes 55 and varies in width gradually broader from one end to another end. As shown in FIG. 3D, the screening bar 53 has a front width Wf at its front or upstream end and a rear width Wr, smaller than the front width Wf, at its rear or downstream end. The screening bars 53 are arranged in parallel at regular transverse separations to form a slit 56 varying in width gradually broader from one end to another end between each adjacent grade bars 53. The screening plate 16 thus structured provides parallel screening slots 56 varying in width gradually broader from the upstream end to the downstream end. The screening slots 56 varying in width gradually broader make contribution to preventing sand clods from being caught by the screening bars 53 during transportation of sand.

Figure 4:
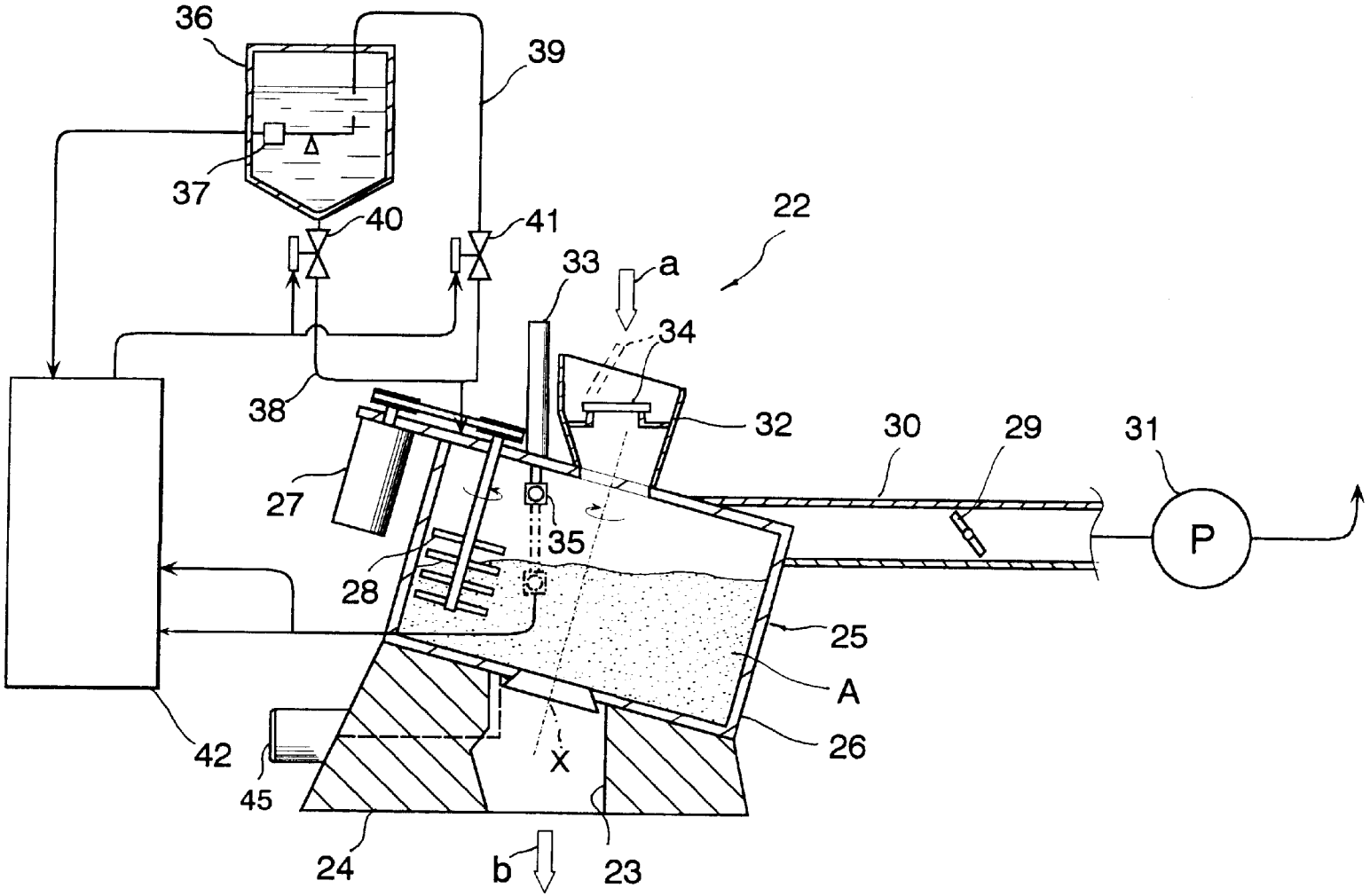
FIG. 4 is a schematic illustration showing a vacuum kneading machine and its associated devices.

FIG. 4 shows the details of the vacuum kneading machine 22 installed at the sand treating station S4. A tilted vacuum mixer 25 has a mixing chamber 26 mounted on a base 24 formed with a discharge port 23 through which recycled molding sand is discharged and a motor 45 for driving the mixing chamber 26 about an inclined axis of rotation X. The mixing chamber 26 of the vacuum mixer 25 is provided therein with a stirrer 28. A motor 27 is mounted on the outside of the mixing chamber 26 to drive the stirrer 28 in a direction opposite to the direction of rotation of the mixing chamber 26. The inside of the mixing chamber 26 is connected to a vacuum pump 31 through a vacuum duct 30 with a shut-off valve 29 disposed therein. The vacuum pump 31 draws a vacuum on the inside of the mixing chamber 26 to a specified vacuum level of, for instance, approximately 70 Hp (Hecto-pascal). The mixing chamber 26 is provided with a hopper 32 mounted on a top deck thereof and a sensor 35 movable up and down within the mixing chamber 26. A shutter 34 in the hopper 32 opens and shuts off the passage in communication with the inside of the mixing chamber 26. The sensor 35 is driven by a cylinder 33 to move down into a stack of molding sand to detect a temperature and a water content of the molding sand. Various types of sensors for detecting the temperature and water content of molding sand are known in the art and the sensor 35 may take any known type.

As shown by an arrow a, the fine-grains of fatigued molding sand A transported by the belt conveyer 18 are thrown into the mixing chamber 26 together with binder, such as bentonite, of an amount corresponding to the amount of fatigued molding sand A while the shutter 34 remains open. The sensor 35 is moved down into the stack of the fine-grains of fatigued molding sand A as shown by a broken line while the stirrer 28 stirs the fine-grains of fatigued molding sand A.

A water tank 36 is disposed above the vacuum mixer 25 to supply water into the interior of the mixing chamber 26 through water feed pipes 38 and 39. Specifically, the water feed pipe 38 connects the bottom of the water tank 36 and the inside of the mixing chamber 26 of the vacuum mixer 25, and the water feed pipe 39 connects the top of the water tank 36 and the inside of the mixing chamber 26 of the vacuum mixer 25. These water feed pipes 38 and 39 are provided with feed valves 40 and 41, respectively. Water supplied through the water feed pipe 38 serves as moisturizing water. The amount of moisturizing water is controlled to provide a specified water content of a mixture of fatigued molding sand and binder necessary to form a greensand mold. On the other hand, water supplied through the water feed pipe 39 serves as cooling water for the fine-grains of fatigued molding sand A which is still at a high temperature during vacuum kneading of the stack of fatigued molding sand A. This cooling water evaporates during cooling the fatigued molding sand. A load cell 37 is installed within the water tank 36 to detect the amount of water supplied into the mixing chamber 26. This load cell 37 may be of a type comprising a elastic metal and a strain gauge responding to a strain of the elastic metal due to a load.

A control unit 42 receives signals representative of the temperature and the water content of the molding sand in the mixing chamber 26 and a signal representative of a water level of the water tank 36 to control the feed valves 40 and 41 based on the signals so as to supply desired amounts of moisturizing water into the mixing chamber 26 through the water feed pipes 38 and 39.

The fine-grains of fatigued molding sand A is transported to the sand treating station S4, the shutter 34 of the hopper 32 opens to introduce the fatigued molding sand A and a binder into the mixing chamber 26. The binder is added at a specified weight ratio relative to the amount of fatigued molding sand A. Subsequently, after closing the shutter 34, the stirrer 28 and the mixing chamber 26 are driven in opposite directions to stir and mix the fine-grains of fatigued molding sand A and the binder. While stirring and mixing the molding sand and binder, the cylinder 33 is actuated to move the sensor 35 down into the stack of sand-binder mixture. The control unit 42 receives signals from the sensor 35 to detect the temperature and the water content of the sand-binder mixture. The control unit 42 opens the feed valve 40 for a time period according to the water content to supply water into the mixing chamber 26 through the water feed pipe 38. The amount of moisturizing water is automatically regulated based on the water content of the sand-binder mixture so as to provide proper moisture in the sand-binder mixture necessary to retain the shape of a greensand mold.

The vacuum pump 31 is driven to draw a vacuum on the inside of the mixing chamber 26 to a vacuum level of approximately 70 Hp, and then the control unit 42 opens the feed valve 41 for a time period according to the water temperature to supply cooling water into the mixing chamber 26 through the water feed pipe 39. The sand-binder mixture is quickly cooled down to a desired temperature of, for example, approximately 40° C. by the latent heat of the cooling water during vaporization. The amount of cooling water is automatically regulated based on the temperature of the sand-binder mixture so as not to change the water content of the sand-binder mixture. Because the cooling water is supplied into the mixing chamber 26 by vacuum suction of water from the top of the water tank 36, the load cell 37 is free from the weight of water and the vacuum during the vacuum suction, so as to precisely respond to a change in water pressure imposed thereon. The water tank 36 does not suffer such aggravation of the responsibility of the load cell 37 as generally caused due to the weight of water and the vacuum during the vacuum suction if the water is sucked from the bottom of the water tank 26. After the vacuum kneading, the moisturized sand-binder mixture is discharged as revived or refreshed molding sand onto a belt conveyer (not shown) through the discharge port 23 as shown by an arrow b. Because the fatigued molding sand A remains still at a high temperature when collected, the refreshed molding sand A is improved in strength through kneading in a vacuum.

Figure 5:
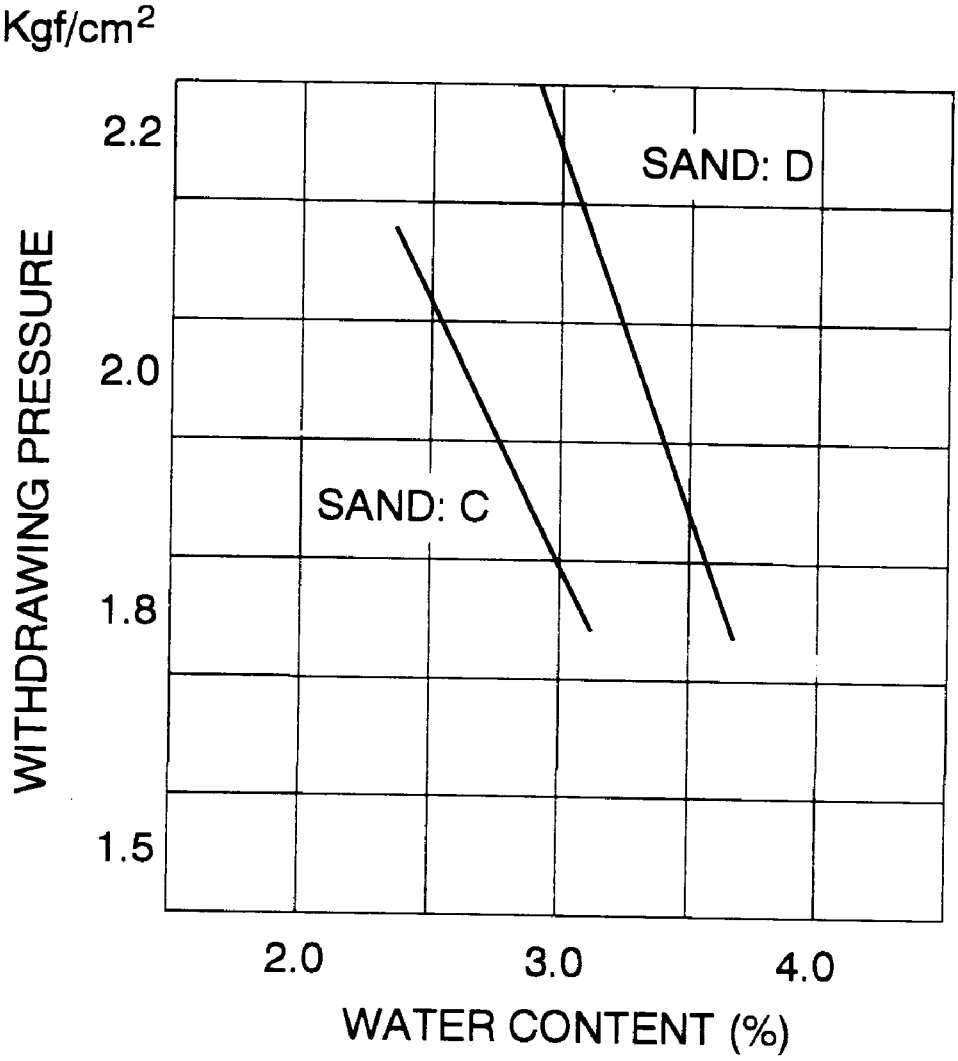
FIG. 5 is a diagrammatic view showing the relationship between withstanding pressure of recycled molding sand with respect to water content.
Figure 6:
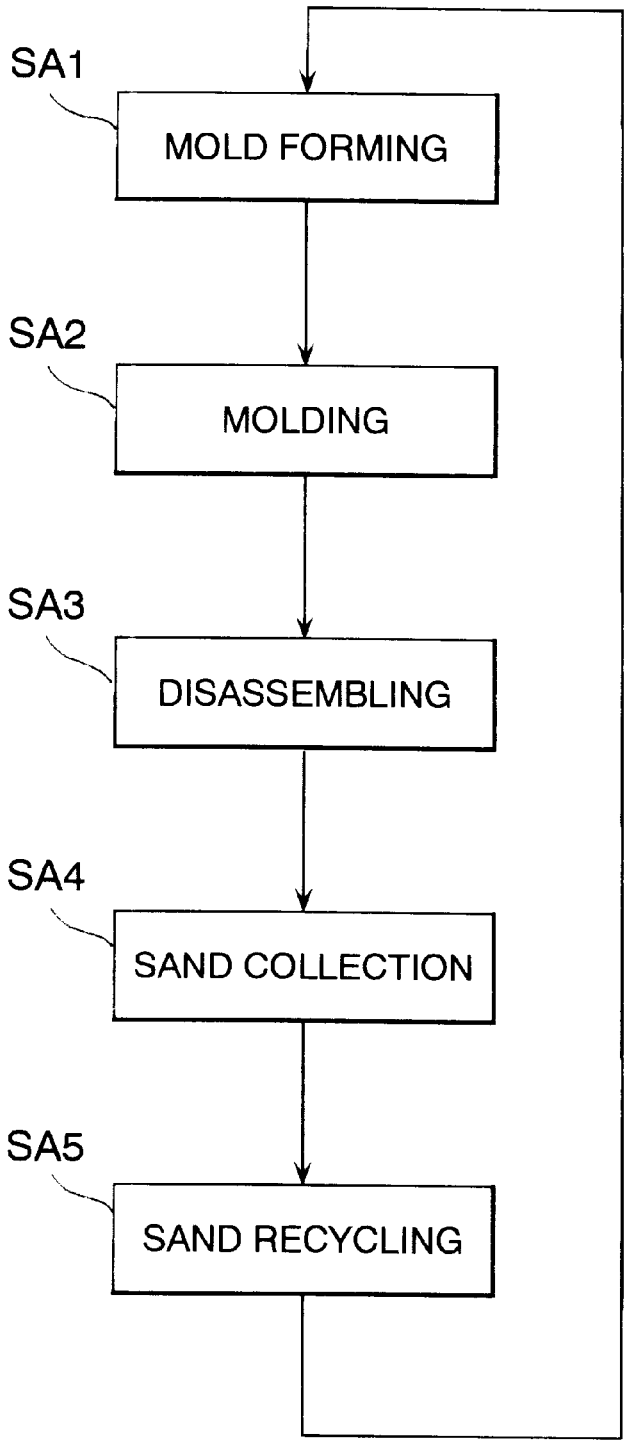
FIG. 6 PRIOR ART
FIG. 6 is a block diagram showing a prior art molding sand recycling process.
Figure 7:
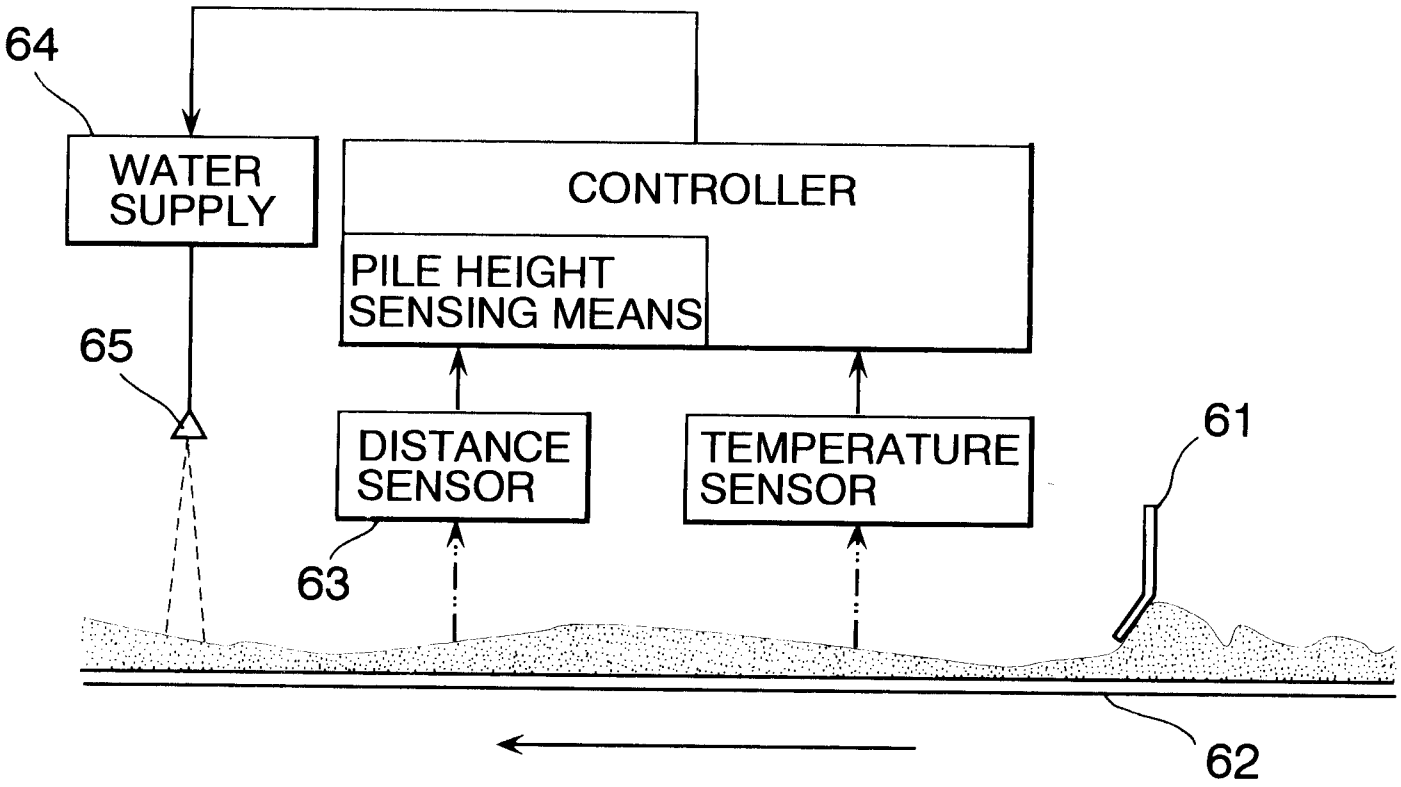
FIG. 7 PRIOR ART
FIG. 7 is a schematic illustration showing a prior art water adding apparatus.

FIG. 5 shows characteristics of the relationship between the withstanding pressure of a greensand mold and the water content of recycled molding sand after the vacuum kneading of which the greensand mold was made. The characteristic L indicates the withstanding pressure of a greensand mold relative to the water content of molding sand at a temperature of approximately 25° C. when collected, and the characteristic H indicates the withstanding pressure of a greensand mold relative to the water content of molding sand at a temperature of approximately 65° C. when collected. As apparent from the characteristics L and H, the molding sand provides higher withstanding pressure of a greensand mold when it has a high temperature when collected as compared with the same having a low temperature even when the molding sand after vacuum kneading has the same water content thereof. This is considered as the result of an increase in the amount of cooling water supplied to the molding sand with a rise in sand temperature which yields an increase in the amount of vapor in the mixing chamber 26 and enhances activation of the bentonite due to an increase in the amount of water permeating into and adsobed by a crystal layer of the bentonite.

After the vacuum kneading of the molding sand, the recycled molding sand is discharged onto the belt conveyer through the discharge port 23 of the base 24 and transported to the blending station T5 where the molding sand A and B are mixed together. The recycled molding sand is further transported to the mold forming station S1 and reused as a molding sand to form a greensand mold.

With the method of recycling of molding sand according to the invention as described above, after molding sand has been used for a greensand mold, the deteriorated or fatigued part or outer-shell of molding sand A, which has been easily collapsible due to thermal deterioration, is positively segregated from the vigorous part or inner-shell of molding sand B by means of the vibrating conveyer 14.

It is to be understood that although the present invention has been described with regard to preferred embodiments thereof, various other embodiments and variants may occur to those skilled in the art, which are within the scope and spirit of the invention, and such other embodiments and variants are intended to be covered by the following claims.

What is claimed is:

1. A method of recycling molding sand of a used greensand mold, which comprises the steps of:

collecting separately sand forming an outer-shell portion of a greensand mold exposed almost directly to heat transferred from a molten material in an interior of the greensand mold and sand forming an inner-shell portion of the greensand mold surrounding said outer-shell portion of the greensand mold;

adding water and binder to said sand forming said outer-shell portion to reproduce molding sand;

mixing said molding sand with said sand forming said inner-shell portion.

2. The molding sand recycling method as defined in claim 1, wherein said molding sand is kneaded in vacuum.

3. The molding sand recycling method as defined in claim 2, wherein said water is added as moisturizing water to provide a specified water content of said molding sand and as cooling water to cool said sand forming said outer-shell portion during vacuum kneading.

4. The molding sand recycling method as defined in claim 2, wherein said water as cooling water is increased in amount with a rise in temperature of said sand forming said outer-shell portion.

5. The molding sand recycling method as defined in claim 1, wherein said water as moisturizing water is increased in amount with a decline in water content of said sand forming said outer-shell portion.

6. The molding sand recycling method as defined in claim 1, wherein said sand forming said outer-shell portion and said sand forming said inner-shell portion are separated by a vibrating slit screen having a specified width of slits.

7. A molding sand recycling system for recycling molding sand of a used greensand mold, which comprises:

separating means for separating sand forming an outer-shell portion of a greensand mold exposed almost directly to heat transferred from a molten material in an interior of the greensand mold and sand forming an inner-shell portion surrounding said outer-shell portion of the greensand mold from each other;

collecting means for separately collecting said sand forming said outer-shell portion and said sand forming said inner-shell portion; and a sand reproducing means for adding water and binder to said sand forming said outer-shell portion and kneading said sand forming said outer-shell portion mixed with said water and binder to reproduce molding sand.

8. The molding sand recycling system as defined in claim 7, wherein said sand reproducing means comprises a water supply and a vacuum kneading apparatus.

9. The molding sand recycling system as defined in claim 7, and further comprising mixing means for mixing said molding sand and said sand forming said inner-shell portion.

10. The molding sand recycling system as defined in claim 7, wherein said separating means comprises a vibratory conveyer equipped with a slit screen having a specified width of slits on which said greensand mold is placed.

11. A molding sand recycling system for recycling molding sand of a used greensand mold, which comprises:

a vibratory conveyer equipped with a slit screen having a specified width of slits on which a greensand mold after usage is placed to separate sand forming an outer-shell portion of said greensand mold exposed almost directly to heat transferred from a molten material in an interior of the greensand mold and sand forming an inner-shell portion of the greensand mold surrounding said outer-shell portion;

a belt conveyer for collecting said sand forming said outer-shell portion passing through said slits thereon and said sand forming said inner-shell portion and transporting said sand forming said outer-shell portion; and a reproducing installation for adding water and binder to said sand forming said outer-shell portion and kneading said sand forming said outer-shell portion mixed with said water and binder to reproduce molding sand.

12. The molding sand recycling system as defined in claim 11, wherein said reproducing installation comprises a water supply and a vacuum kneading apparatus.

13. The molding sand recycling system as defined in claim 12, wherein said vacuum kneading apparatus includes a sand condition sensor for detecting a temperature and a water content of said sand forming said outer-shell portion and a control unit for determining an amount of water to be added to said sand forming said outer-shell portion based on said temperature and said water content and controlling said water supply to supply said amount of water to said sand forming said outer-shell portion.

* * * * *